US006192949B1

(12) United States Patent
Nien

(10) Patent No.: US 6,192,949 B1
(45) Date of Patent: Feb. 27, 2001

(54) METHOD FOR MAKING BAMBOO BLIND SLATS

(75) Inventor: Ming Nien, Changhua Hsien (TW)

(73) Assignee: Nien Made Enterprise Co., Ltd., Hsien (TW)

( * ) Notice: Subject to any disclaimer, the term of this patent is extended or adjusted under 35 U.S.C. 154(b) by 0 days.

(21) Appl. No.: 09/442,265

(22) Filed: Nov. 18, 1999

(51) Int. Cl.[7] ..... B27D 1/00

(52) U.S. Cl. ..... 144/350; 144/3.1; 144/5; 144/348; 144/351; 144/392; 144/367; 144/369; 144/364; 144/380; 156/62.4; 156/250; 156/296; 428/105; 428/106; 428/537.1; 428/378

(58) Field of Search ..... 144/3.1, 5, 345, 144/346, 349, 350, 351, 352, 361, 362, 364, 367, 369, 380; 15/62.4, 62.6, 250, 296; 428/105, 106, 107, 378, 57, 537.1

(56) References Cited

U.S. PATENT DOCUMENTS 5,896,903 4/1999 Chen et al. ..... 144/350

*Primary Examiner*—W. Donald Bray
(74) *Attorney, Agent, or Firm*—Browdy and Neimark

(57) ABSTRACT

A method is designed for making bamboo blind slats. The method comprises an initial step in which a selected bamboo stem is split into a plurality of bamboo strips, which are then skinned and disinfected with a sulfur fume for over 12 hours. The disinfected bamboo strips are dried by baking before they are provided with a layer of adhesive. The coated bamboo strips are joined together in conjunction with a pneumatic press to form a rectangular bamboo plate, which is subsequently sliced into a plurality of bamboo slats, with each having a width and a thickness. The bamboo slats are smoothed by grinding and are then covered with a base coating and a face coating which is applied on the base coating. The twice-coated bamboo slats are punched so as to enable them to accommodate the pull cords of a Venetian blind comprising the bamboo slats which are made by the method of the present invention.

1 Claim, 4 Drawing Sheets

METHOD FOR MAKING BAMBOO BLIND SLATS

FIELD OF THE INVENTION

The present invention relates generally to the bamboo blind slats, and more particularly to a method for making the bamboo blind slats.

BACKGROUND OF THE INVENTION

The slats of the conventional Venetian blinds are generally made of a PC or aluminium material, which is an industrial pollutant. With a view to protecting the environment, certain conventional Venetian blind slats are made of wood or bamboo.

The U.S. Pat. No. 5,896,903 discloses a method for making the bamboo blind slats. The method comprises a first step in which a selected bamboo stem of a predetermined length is split into a plurality of bamboo strips. The skins and the joints of the opposite sides of the bamboo strips are removed before the bamboo strips are bleached and preserved in a boiling solution of the diluted peroxide for more than 8 hours. The bleached and disinfected bamboo strips are then dried by baking and smoothed by grinding. The smoothed bamboo strips are covered with an adhesive coating, so as to enable the longitudinal sides of the bamboo strips to stick together such that the bamboo strips form together a rectangular bamboo plate, which is subsequently divided into a plurality of bamboo block s of a width. The periphery of the bamboo blocks is properly dressed. The dressed bamboo blocks are cut into a plurality of bamboo slats having a predetermined thickness. The bamboo slats are smoothed by grinding and are then covered with a foundation coat. The coated bamboo slats are airdried before they are covered with a face coating. Finally, the bamboo slat s are punch ed to accommodate the pull cords of a Venetian blind made of the bamboo slats.

Such a prior art method a s described above is not entirely efficient in that it involves at least 14 steps, which are inefficient and time-consuming at best.

SUMMARY OF THE INVENTION

The primary objective of the present invention is to provide a cost-effective method for making bamboo blind slats.

In keeping with the principle of the present invention, the foregoing objective of the present invention is attained by the method comprising a first step in which a selected bamboo stem is split into a plurality of bamboo strips of a predetermined length. The skins and the joints of the opposite sides of the bamboo strips are removed before the bamboo strips are disinfected with the sulfur fume for at least 12 hours. The disinfected bamboo strips are subsequently dried by baking. The dried bamboo strips are covered with an adhesive coat. The coated bamboo strips are joined together along the longitudinal sides thereof in conjunction with a pneumatic press such that the coated bamboo strips are formed into a rectangular bamboo plate, which is then sliced into a plurality of bamboo slats, with each having a predetermined thickness. The bamboo slats are smoothed by grinding and are then covered with a base coat. The bamboo slats, which have been covered with the base coat, are provided with a layer of a face coat and subsequently punched to accommodate the pull cords of a Venetian blind made of the bamboo slats, which are highly resistant to pressure and deformation.

DETAILED DESCRIPTION OF THE INVENTION

Figure 1:
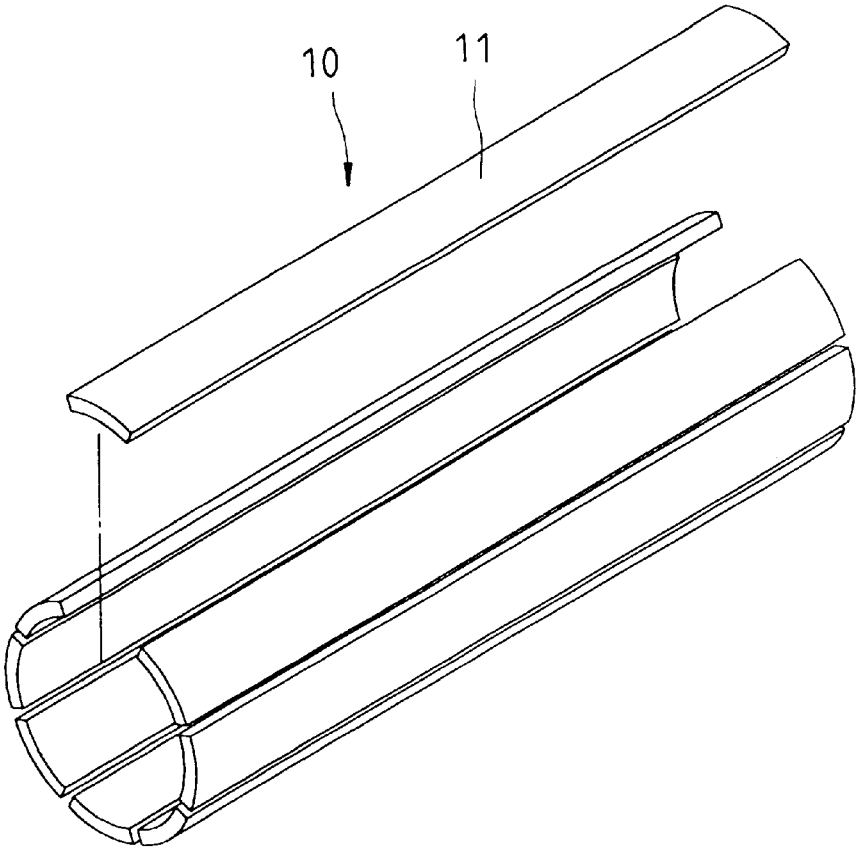
FIG. 1 shows a schematic view of a preferred embodiment of the present invention by which a selected bamboo stem is split into a plurality of bamboo strips.
Figure 2:
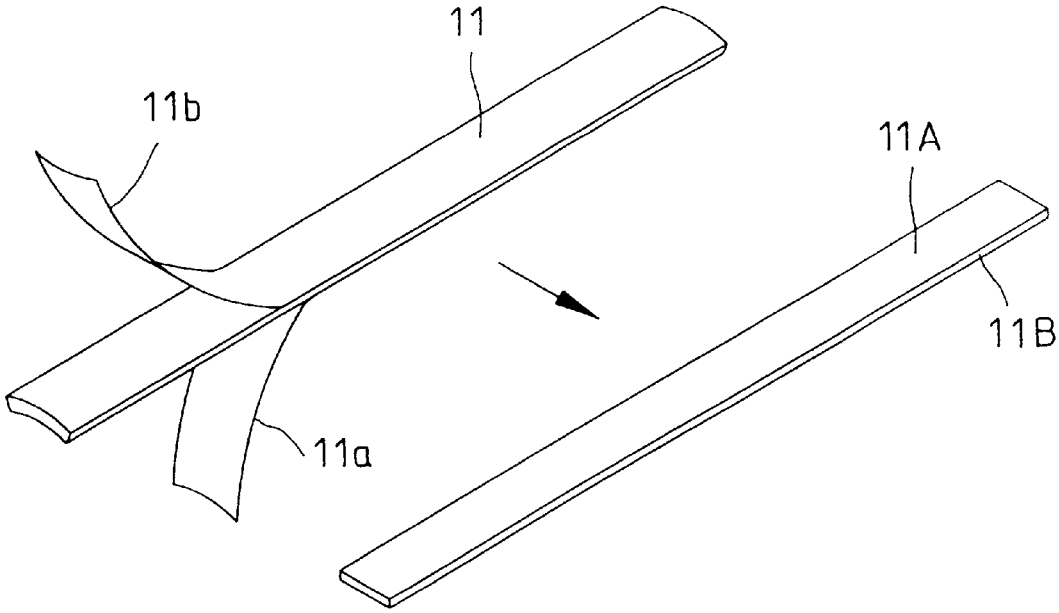
FIG. 2 shows a schematic view of the dressing of the bamboo strips as shown in FIG. 1.
Figure 3:
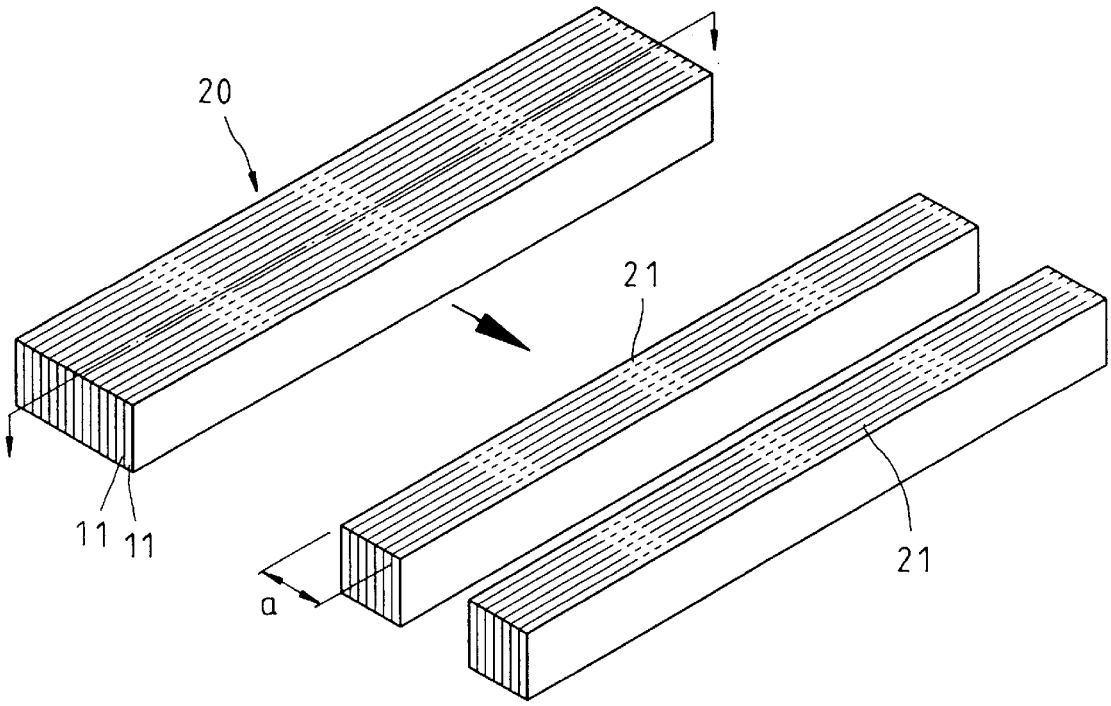
FIG. 3 shows a schematic view of the slicing of the bamboo plate formed by the method of the present invention.
Figure 4:
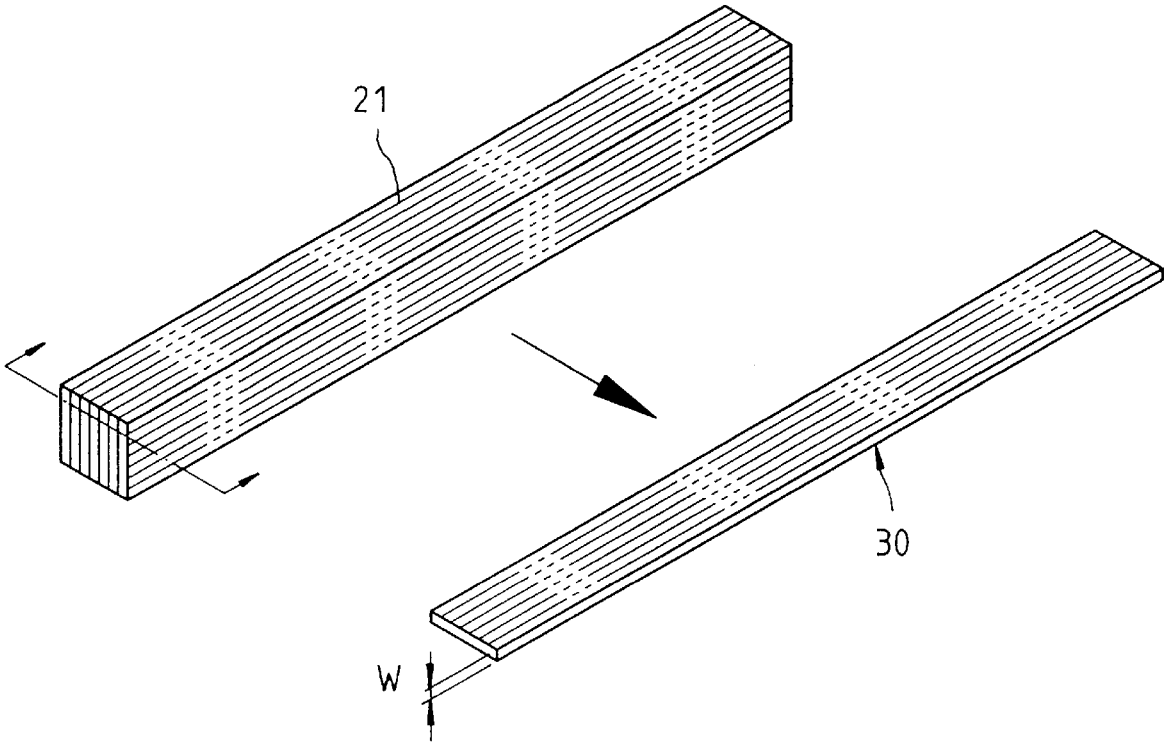
FIG. 4 shows a schematic view of the slicing of the bamboo plate into a plurality of bamboo slats according to the method of the present invention.
Figure 5:
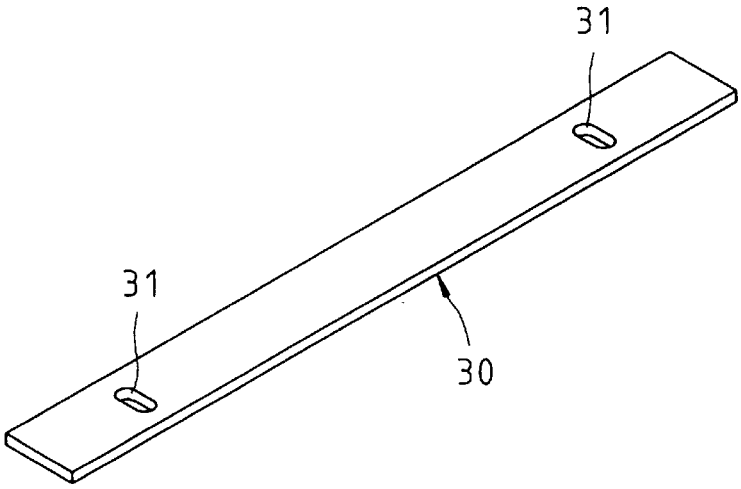
FIG. 5 shows a schematic view of a punched bamboo slat of the preferred embodiment of the present invention.
Figure 6:
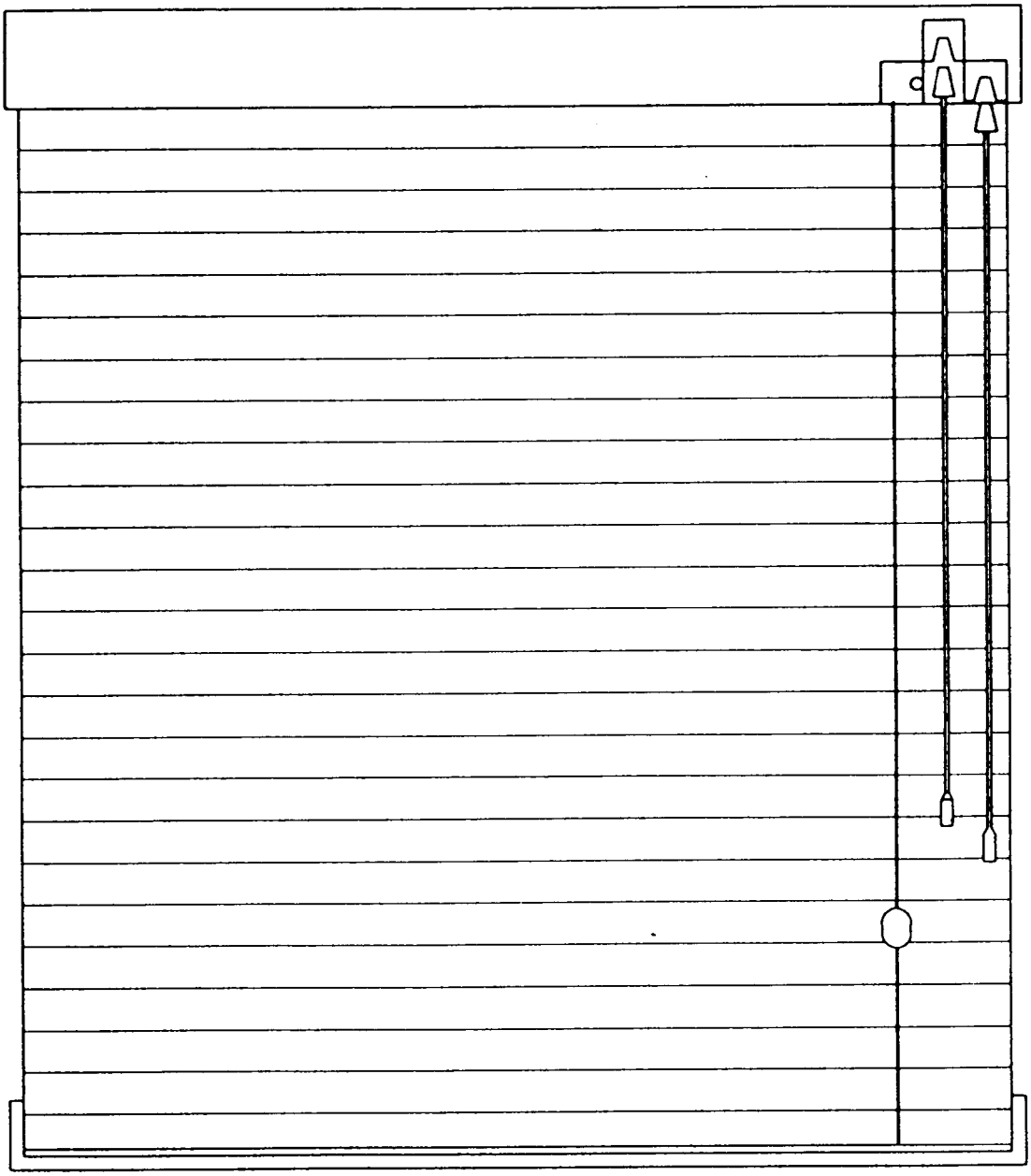
FIG. 6 shows a schematic view of a Venetian blind comprising a plurality of bamboo slats made by the method of the present invention.

As shown in FIGS. 1–5, a method embodied in the present invention comprises a first step in which a selected bamboo stem 10 is split into a plurality of bamboo strips 11, with each having a predetermined length. The skins 11*a* and 11*b* of two opposite longitudinal surfaces of each bamboo strip 11 are removed. As a result, the bamboo strip 11 has two smooth longitudinal surfaces 11A and 11B. The skinless bamboo strips 11 are bleached and disinfected by a sulfur fume for at least 12 hours. The bleached and disinfected bamboo strips 11 are subsequently dried by baking before they are covered with an adhesive coat. The coated bamboo strips 11 are joined together such that the longitudinal surfaces 11A of the coated bamboo strips 11 are adhered together in conjunction with a pneumatic press, and that the coated bamboo strips 11 are formed into a rectangular bamboo plate 20, which is then sliced into a plurality of bamboo blocks 21, with each having a width a. The bamboo blocks 21 are further sliced into a plurality of bamboo slats 30 of a thickness w, as shown in FIG. 4. The bamboo slats 30 are smoothed by grinding before the bamboo slats 30 are covered with a base coat. The coated bamboo slats 30 are subsequently airdried before they are provided with a face coating. Finally, the bamboo slats 30 are punched such that they are provided with two through holes 31, as shown in FIG. 5. The through holes 31 are intended to accommodate the pull cords of a Venetian blind comprising a plurality of bamboo slats 30 which are made by the method of the present invention.

As compared with the method disclosed in the U.S. Pat. No. 5,896,903, the method of the present invention is relatively simple in the manufacturing process, efficient, and cost-effective. In addition, the bamboo slats 30 of the present invention have a better esthetic effect as well as resistance to impact and deformation.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A method for making bamboo blind slats, said method comprising the steps of:

(a) splitting a selected bamboo stem into a plurality of bamboo strips of a length, and removing skins of two opposite sides of each of the bamboo strips;

(b) bleaching and disinfecting the skinless bamboo strips with a sulfur flume for at least 12 hours;

(c) drying the bleached and disinfected bamboo strips by baking;

(d) applying a layer of an adhesive on the smooth bamboo strips;

(e) joining together the coated bamboo strips such that the longitudinal surfaces of the coated bamboo strips are adhered together in conjunction with a pneumatic press, and that the bamboo strips are joined together to form a rectangular bamboo plate (f) slicing the bamboo plate into a plurality of bamboo slats, with each having a thickness;

(g) smoothing the bamboo slats by grinding;

(h) covering the smoothed bamboo slats with a base coating;

(i) covering the bamboo slats of the step (h) with a face coating; and (j) punching the coated bamboo slats of the step to produce at least two cord holes.

* * * * *